United States Patent [19]

Yuhas et al.

[11] Patent Number: 4,634,124

[45] Date of Patent: Jan. 6, 1987

[54] VIBRATION DAMPED SPORTS RACQUET

[75] Inventors: Drew J. Yuhas, Plainsboro; Joseph Boggia, North Brunswick, both of N.J.

[73] Assignee: AMF Incorporated, White Plains, N.Y.

[21] Appl. No.: 688,855

[22] Filed: Jan. 4, 1985

[51] Int. Cl.[4] ..... A63B 49/00

[52] U.S. Cl. ..... 273/73 G

[58] Field of Search ..... 273/73 R, 73 G, 73 E, 273/73 H, 73 D

[56] References Cited

U.S. PATENT DOCUMENTS

| | | | |
|---|---|---|---|
| 3,633,910 | 1/1972 | Spenle | 273/73 J |
| 3,915,453 | 10/1975 | Nishimura | 273/73 G |
| 3,941,380 | 3/1976 | Lacoste | 273/72 A |
| 4,105,205 | 8/1978 | Theodores et al. | 273/73 J |
| 4,139,194 | 2/1979 | Fischer | 273/73 C |
| 4,180,265 | 12/1979 | Staufer | 273/73 D |
| 4,192,505 | 3/1980 | Tabickman | 273/73 C |
| 4,196,901 | 4/1980 | Durbin | 273/73 G |
| 4,330,125 | 5/1982 | Sassler | 273/73 C |
| 4,353,551 | 10/1982 | Arieh et al. | 273/73 R |

FOREIGN PATENT DOCUMENTS

| | | | |
|---|---|---|---|
| 10867 | of 1887 | United Kingdom | 273/73 G |

*Primary Examiner*—Richard C. Pinkham
*Assistant Examiner*—Matthew L. Schneider
*Attorney, Agent, or Firm*—Finnegan, Henderson, Farabow, Garrett & Dunner

[57] ABSTRACT

A sports racquet with a throat piece in which vibrations produced upon impact of a ball on the strung hitting surface are dampened by interposing an elastic dampening device between opposite sides of the throat piece and the otherwise normally abutting inside of each leg of the racquet frame. Another embodiment, with or without a throat piece, provides a nubbed, perforated strip of elastomeric dampening material positioned on the inside of each side of the frame above the racquet throat, so the strings changing direction as they pass through the perforations bear against the protruding nubs which dampens the vibrations propagated along the strings.

5 Claims, 19 Drawing Figures

VIBRATION DAMPED SPORTS RACQUET

BACKGROUND OF THE INVENTION

This invention relates to sports racquets, e.g. tennis, squash and racquetball and more particularly to racquets with features which attenuate or dampen the vibrations caused by impact of a ball on the grid of strings forming the hitting surface.

In stringed racquets, the impact of the ball on the grid of strings deflects the frame and grid backward and the elasticity of the system above the handle acting as a free structure induces it to vibrate after the ball rebounds. The vibration pulses initially propagated in the string grid plane are transmitted through the string connections to both the racquet frame and to the throat piece or yoke in racquets having throat pieces. Since the throat piece is fastened to the racquet frame in the racquet throat area, the throat piece vibrations induced in the throat piece from the string grid are transmitted secondarily to the frame in addition to the grid vibrations transmitted directly to the oval portion of the racquet frame. These vibrations are ultimately received in the racquet handle.

Various methods have been used heretofore to reduce objectionable racquet vibrations.

Tubular racquet frames have been filled with buckshotlike weights free to move on ball impact. Handles have been filled with a viscous fluid. Weights have been placed in holes in the frame face free to move transverse to the racquet face. The motion of the shot, fluid and weights upon impact of the racquet face with the ball is said to dampen vibrations. These proposed solutions are noisy and heavy and not effective over broad frequency ranges.

Each end of a tubular racquet frame has been passed through aligned holes in three spaced plates inside the handle. One tube end is welded to the top and bottom plates with the hole in the middle plate being a clearance hole. The other tube end is welded to the top and bottom plates with the clearance hole being in the bottom plate. The friction of the tubes against the sides of the clearance holes is said to reduce vibrations as the tubes are flexed on impact. This solution is noisy and gives a feeling of something being loose on impact.

Frames have been grooved for the placement of elastomers to cushion the pulling of the strings on the frame and hollow tube frames have been filled with plastic which are said to dampen the frame vibrations. This increases the weight markedly.

A closed hoop instead of the frame has been used for the racquet stringing and the hoop connected by four spaced elastomers to the frame or by two elastomers to the frame and one to a bar across the throat space to dampen the string plane vibrations. This produces a somewhat unsolid sensation upon striking the ball, an unpleasant appearance and an unusual balance.

Another exotic proposed solution uses cantilever structures with a natural frequency equal to the general vibration frequency of the string grid connected to the frame along the longitudinal axis near a vibration antinode to reduce vibrations. The sensitivity of this system is subject to variation with hard play and abuse and it is expensive.

Couplers have been used between adjacent strings so the different resonant frequencies of the individual strings act too dampen their individual vibrations. This tends to affect the rebound characteristics of the racquet when the ball strikes a coupler.

In one construction the mass of the throat area is decreased to move the so-called percussion center of the racquet face toward the tip which is said to also reduce vibrations somewhat. This produces a weight configuration which differs from what the player is used to.

These proposed solutions are all subject to one or more objections, some are expensive, some are subject to getting out of adjustment, some prevent proper hitting of the ball on all positions of the racquet string face, some are too heavy, in some the motion of the dampening components gives a feeling of something being loose when striking the ball, some are expensive, some unusual in appearance, and in some the vibrations are only marginally damped.

It is accordingly an object of the present invention to overcome the shortcomings of the vibration dampening racquets in the prior art.

It is a more specific object of this invention to provide an inexpensive dampening apparatus in a strung racquet that will isolate the throat piece of the racquet from the racquet frame and so dampen vibrations passing from the strings, to the throat piece, to the frame thereby dampening induced frame vibrations and vibrations passing to the handle.

It is an additional object to provide a vibration dampening racquet that does not significantly affect the weight, configuration, appearance or shape of the racquet and has no moving parts.

These and other objects and features will be disclosed from the following specification and drawings.

BRIEF SUMMARY OF THE INVENTION

The present invention overcomes the foregoing shortcomings of prior racquets by interposing a retainer made of material with vibration dampening properties that is somewhat elastic between opposite sides of the throat piece and the normally abutting inside of each leg of a racquet frame, so that the throat piece is retained within and floats on the two compressed retainers at assembly. In a second embodiment the retainer is made of a stiffer material and a protruding dampening material strip is fitted into a recess in each retainer and each strip-retainer pair is placed between opposite sides of the throat piece and the inside of each abutting frame leg at assembly. Precise measurements demonstrate that these embodiments significantly reduce impact induced frame vibrations, before they reach the gripping surface of the racquet, presumably by dampening string grid plane vibrations transmitted from the strings through the throat piece before they pass from the throat piece to the frame.

In a third embodiment, a nubbed perforated strip of elastomeric material with nubs of suitable heights protruding above the strip is positioned above the racquet throat. As the strings change their direction in going through the perforations in the frame, they bear against the individual nubs whereby the propagated vibrations are dampened.

DETAILED DESCRIPTION OF THE PREFERRED EMBODIMENT

It was initially decided to determine which of the frequencies of a spectrum of frequencies induced in the grid of strings plane and the frame of a representative model throat piece racquet produced objectionable responses in the racquet handle and design dampening apparatus to attenuate the amplitude of these frequencies to acceptable levels. It should be understood that the frame will vibrate at additional frequencies than the reasonant frequency of the string grid.

Figure 1:
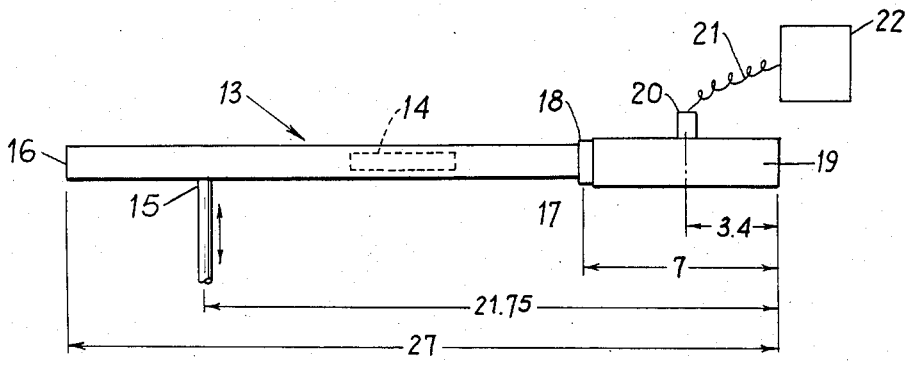
FIG. 1 is a schematic view of a tennis racquet with a throat piece showing the test set up used to investigate the vibrations experienced in the handle, with and without the dampening means of this invention.
Figure 2:
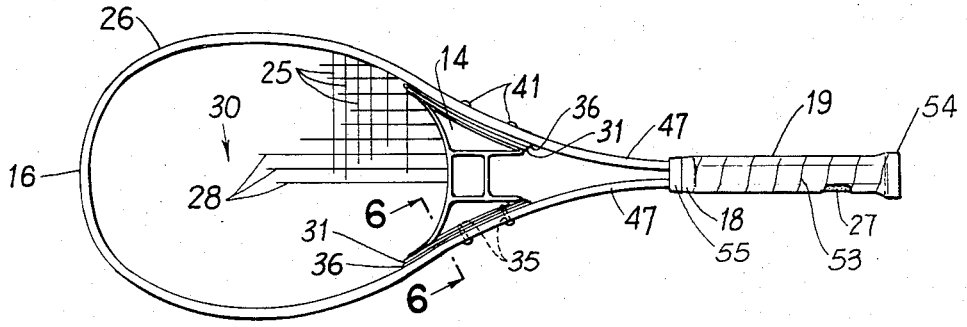
FIG. 2 is a plan view of a tennis racquet with a throat piece equipped with the apparatus of this invention for dampening vibrations.

FIG. 1 shows the test set up employed to determine vibration responses on a typical tennis racquet 13 with a throat piece 14, such as illustrated in FIG. 2. The anvil of a commercial vibrator 15 was placed as one racquet support on the longitudinal center line at a distance of $5\frac{1}{4}''$ from the racquet tip 16 which position appeared to generate the maximum response in the handle of the racquet. The anvil was of a size to just cover adjoining vertical and horizontal strings at this point. An 18" block of soft foam 17 placed at the top cap 18 of the handle served as the other racquet support. An accelerometer 20 was glued to the foamed surface 27 of the handle 19 which had the adhesive tape 55, the leather wrapping 53 and the butt cap 54 removed. The accelerometer was connected through leads 21 to oscilloscope 22.

Figure 3:
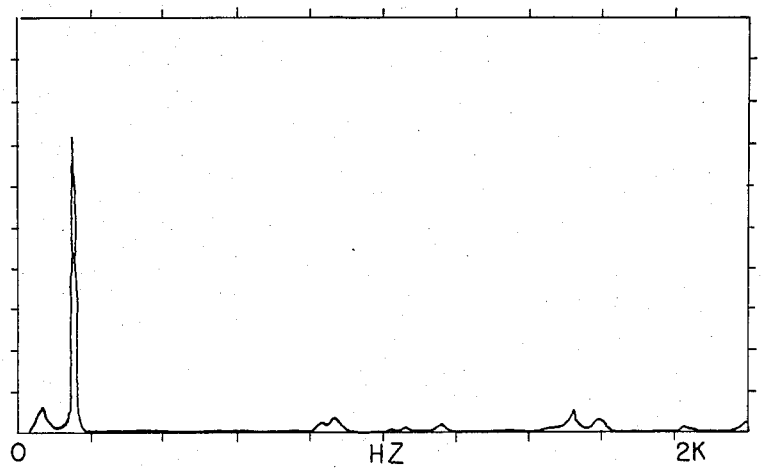
FIG. 3 is a chart showing in relation to frequency of vibrations transmitted by the vibrator anvil shown in FIG. 1, the amplitude of the vibrations sensed by the accelerometer at the handle as transmitted to an oscilloscope and displayed for the tennis racquet of FIG. 2 but without any dampening means on the racquet.

The frequency of the vibrator was varied from 50 Hz. to 2,000 Hz. at 2.5 volts RMS, 2.1 amperes D.C. input and the frequency scan profile shown in FIG. 3 at the position of accelerometer 20 shown in FIG. 1 was obtained. For the racquet tested, only one significant vibration amplitude was observed at the handle, occurring at 152.6 Hertz. This frequency is induced by the composite free structure system of frame and string grid but appears to be mainly due to the elasticity of the frame and the second bending moment thereof considering the system as a beam (see U.S. Pat. No. 4,196,901). Nevertheless, upon ball impact, the initial waves are propagated in the strings and pass outwardly from the point of impact.

There are two paths for string vibrations to reach the handle in a racquet with a throat piece. Referring to FIG. 2, transverse strings 25 are connected above the throat piece 14 directly to the frame 26, the lower ends 47 of which are enclosed within the handle 19, so the vibrations pass from string plane to frame to handle. Longitudinal strings 28 are connected to the throat piece 14 so the vibrations also pass from string plane to throat piece to frame to handle.

The first two embodiments of the present invention attenuate the vibrations at the handle surface by means of dampening devices, separating the throat piece from the frame.

Figure 6:
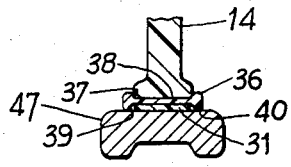
FIG. 6 is a sectional view of the frame, throat piece and dampening devices of FIG. 2 taken along the plane 6—6.

FIGS. 2 and 6 show assembled to the frame, pairs of two piece retainer-dampening devices 36 and 31 for dampening the passage of vibrations through the path from string plane 30 through throat piece 14 to the frame legs 47 and for dampening impact induced frame vibrations through the other path by dampening motions of the frame relative to the string plane at the throat. Reference to FIGS. 4*a*, 4*b*, 5*a*, 5*b* and 6 show the details.

Retainer 36 is rectangular in shape with a raised edge 37 around the periphery defining a recess 38 to retain the throat piece 14. The other side of retainer 36 also has a raised edge 40 around the periphery to define a recess 39. The retainer is molded preferably of 3189 nylon with a 0.030" or 0.040" thickness between the peripheral edges. Dampening strip 31 is retained within recess 39 when the retainer strip 36 and the dampening strip are used together. The depth 39 of the retainer 36 is less than the thickness 32 of the dampening strip 31, so that the loads are carried by the dampening strip material when the retainer 36 and the dampening strip 31 are assembled together to the frame legs 47.

Dampening strip 31 is rectangular in form, of constant thickness 32 with a series of holes 34 for the passage of racquet strings and with clearance holes 33 for the passage of fasteners 35. These holes correspond to those in retainer 36. Dampening strip 31 is made of a suitable elastomeric dampening material such as Isodamp C 1100, C 1002 or C 2003 manufactured by Cabot Corporation, SMRD manufactured by General Electric or Poron manufactured by Rogers Corp.

The nylon throat piece 14, two dampening retainers 36 and two dampening strips 31, if a two piece retainer-dampening device is used, are assembled to the frame sides with fasteners 35 as shown in FIG. 2. Plugs 41 cover the fasteners.

Figure 4A:
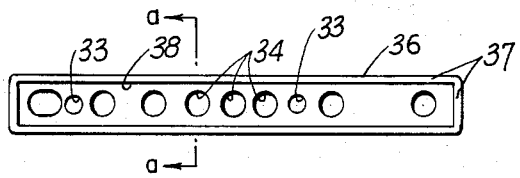
FIG. 4*a* is a plan view of the dampening retainer of FIG. 2.
Figure 4B:
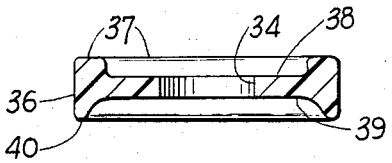
FIG. 4*b* is a sectional view of the dampening retainer of FIG. 4*a* along the plane a—a.
Figure 4C:
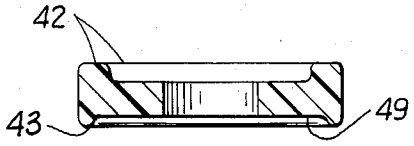
FIG. 4*c* is a sectional view of a second dampening retainer with an identical plan view to that shown in FIG. 4*a*.
Figure 5A:
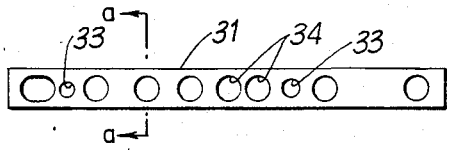
FIG. 5*a* is a plan view of the dampening strip of FIG. 2.
Figure 5B:
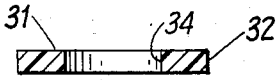
FIG. 5*b* is a sectional view of the dampening strip of FIG. 5*a* along the plane a—a.

A second embodiment of this invention includes the one piece dampening device illustrated in FIG. 4*c* in which the retainer 42 is made from a dampening material such as listed above. The plan view of retainer 42 is the same as retainer 36 illustrated in FIG. 4*a*, with corresponding holes but as shown in FIG. 4*c* the depth of recess 49 is less than recess 39 in retainer 36 because dampening strip 31 is not used. At assembly peripheral edge 43 is directly in contact with frame leg 47.

It should be understood that features of the configuration of dampening retainer 36 or of retainer 42 could be designed integrally into throat piece 14 rather than having them in a separate piece.

A number of samples of the same model of tennis racquet used in obtaining the data shown in the following charts were strung to substantially the same string tension and tested with the set up of FIG. 1 to determine which frequency produced the maximum accelerometer response. The differences between the frequencies giving maximum response of different samples of the same model were relatively insignificant. Nevertheless the tests were run at the individual sample's actual maximum response inducing frequency.

FIG. 3 shows the amplitude of the vibrations at the handle in relation to the scan of frequencies applied to the string grid by the vibrator on a racquet as illustrated in FIG. 2 without any dampening means.

Figure 7:
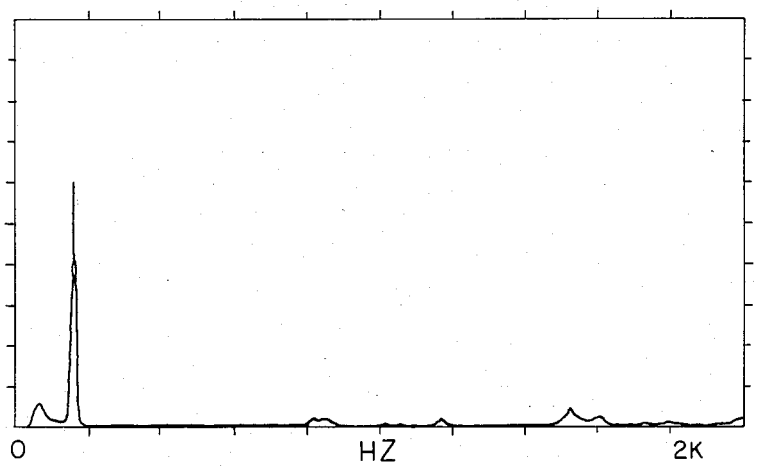
FIG. 7 is a chart similar to FIG. 3 showing vibration amplitude in relation to vibration frequency for the racquet illustrated in FIG. 2 with only a pair of one piece dampening strips between the frame sides and the throat piece.

FIG. 7 shows the same test on a racquet with a pair of one piece dampening strips 31. The peak amplitude is less than that for the racquet of FIG. 3 without any dampening means at all.

Figure 8:
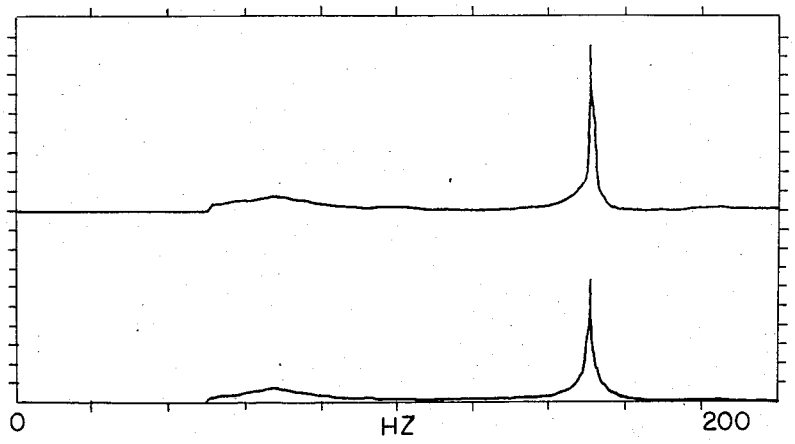
FIG. 8 is a chart similar to FIG. 3 but with a smaller range of frequencies, comparing the vibration amplitude in relation to vibration frequency for the racquets of FIG. 2, the upper curve for a racquet without any dampening means, the lower curve for a racquet with throat piece to frame dampening.
Figure 9:
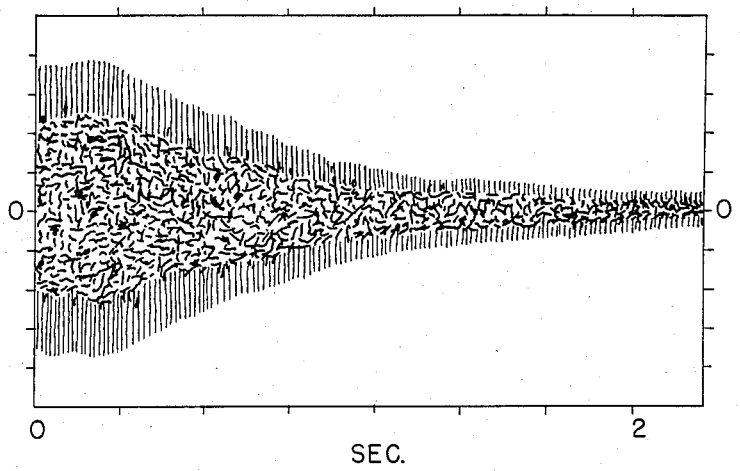
FIG. 9 is a chart for the racquet of FIG. 2 without any dampening means showing the decay of vibration amplitude in relation to time after the steady state resonance frequency input was removed.
Figure 10:
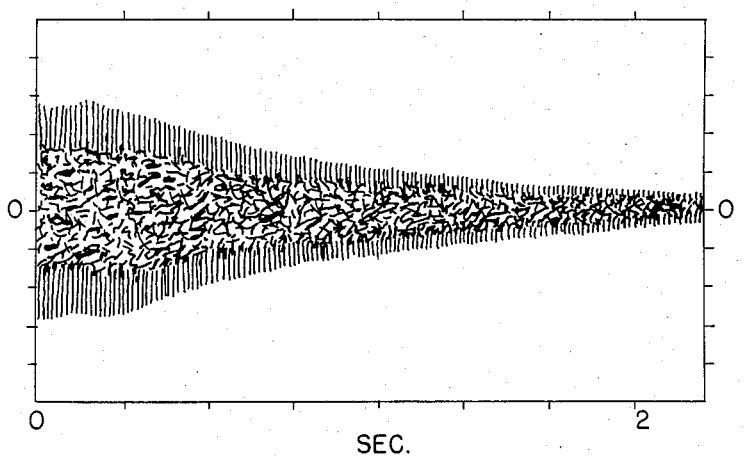
FIG. 10 is a chart similar to FIG. 9 for the racquet of FIG. 2 with only a pair of one piece dampening strips between the frame sides and the throat piece.
Figure 11:
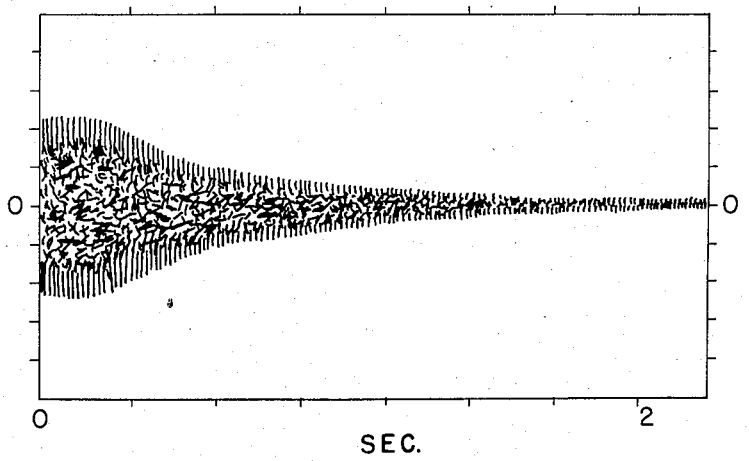
FIG. 11 is a chart similar to FIG. 9 for the racquet of FIG. 2 with throat piece to frame dampening.

A direct visual comparison is obtained from FIG. 8 where the frequency scale is larger and the vibration response, FIG. 3 of the undampened racquet is shown directly above the vibration response of the racquet with pairs of dampening strips 31 and pairs of retainers 36. In FIGS. 9–11, the resonant frequency (which produces the peak vibration) of each sample racket was continuously applied by the vibrator until the response stabilized. Then the input was cut off and the decay curve recorded for each sample.

The slowest decay shown in FIG. 9 occurred in the completely undamped racquet charted in FIG. 3. The next slowest decay shown in FIG. 10 occurred in the racquet dampened only by the pair of one piece dampening strips 31.

The fastest decay is shown in FIG. 11 for the racquet dampened with pairs of dampening strips 31 and retainers 36.

Figure 12:
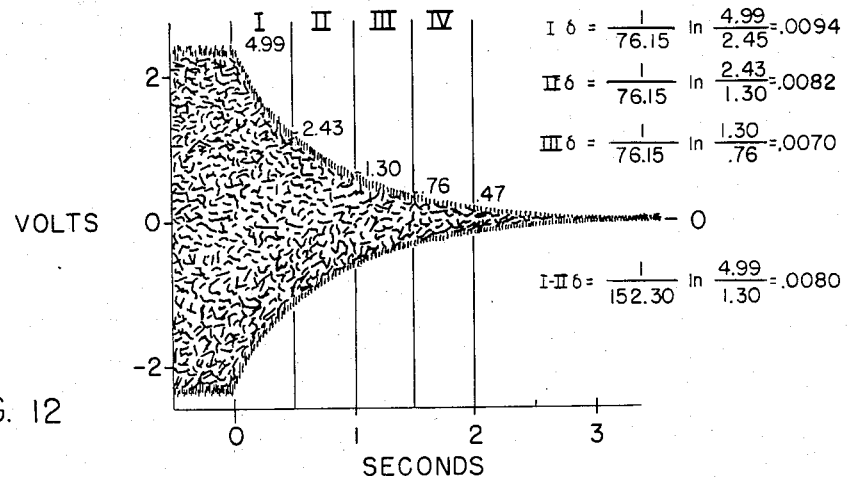
FIG. 12 is a chart for the racquet of FIG. 2 without any dampening means and with substantially the same vibration amplitude and decay time data as FIG. 9 but using a larger scale for amplitude and a smaller scale for decay time.

To further study the rate of decay, the vibrator output energy applied to the racquet whose response was charted in the lower half of FIG. 8 which was equipped with pairs of dampening strips 31 and retainers 36 was increased until the peak amplitude on this racquet was the same as the peak amplitude of the racquet charted in FIG. 9 without any dampening means. When the accelerator response stabilized, the vibrator was cut off and the response plotted but on a larger amplitude scale and a smaller time scale. FIG. 12 shows the results for the completely undampened racquet and FIG. 13 for the racquet with dampening strips and retainers.

Figure 13:
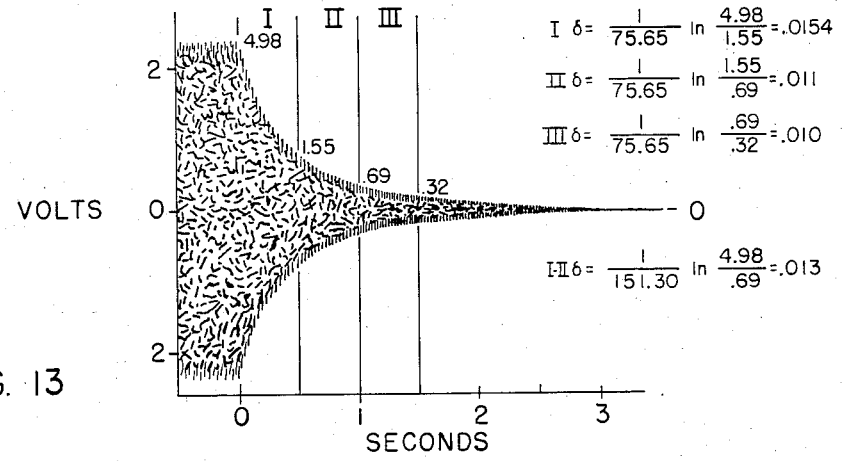
FIG. 13 is a chart showing the decay of vibration amplitude in relation to time for the racquet of FIG. 2 with throat piece to frame dampening but with the input to the vibrator of FIG. 1 increased over that used in FIG. 9 to produce the same steady state vibration output shown in FIG. 12.

These decays were measured and the log decrements computed for each half second of the applied frequency producing the maximum response using the formula, "2 times the period multiplied by the natural logarithm of the quotient of the vibration amplitude at the start of the half second divided by the amplitude at the end of the half second." The results are shown in FIGS. 12 and 13. They show that the rate of decay in the first half second after cut-off using 0.035 inch Cabot Isodamp C 1100 material for the dampening strip and 0.040 inch nylon for the retainer 36 was 64% greater for the racquet with dampening strip-retainer dampening than for the racquet without any dampening. It also showed that input had to be doubled in the racquet with dampening strip-retainer dampening to make it vibrate as badly as the completely undamped racquet.

The embodiments of this invention described heretofore employ the dampening devices between opposite sides of the throat piece and what would be the normally abutting inside of each leg of the racquet frame and the area of the devices is substantially limited to the area of the frame covered by the throat piece sides. However, the scope of the invention, particularly with respect to racquetball racquets, also covers dampening devices above the throat piece, both as separate pieces and as extensions of the material under the throat piece sides. The separate piece embodiment described below may also be used for dampening vibrations in stringed racquets without throat pieces.

Figure 14A:
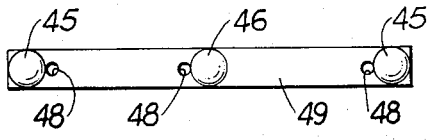
FIG. 14*a* is a plan view of a perforated, nubbed elastomeric strip used in this invention for dampening vibrations.
Figure 14B:
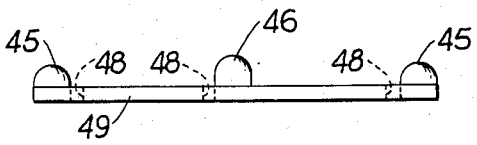
FIG. 14*b* is a elevation view of the strip shown in FIG. 4*a*.

FIG. 14*a* shows a plan view of a separate nubbed strip 49 molded from an elastomeric material such as Reichold Chemical Incorporated's TPR material with string holes 48 and roughly hemispherical nubs 45 and 46. Nub 46 is higher than nubs 45 as shown in FIG. 14*b*. The configuration of the individual nubs is determined by the height needed to interfere with passage of the closest string as can be seen from FIG. 15 in which longitudinal strings 28 bend around and bear against nubs 45 and 46 as they change from a longitudinal to a transverse direction in passing through the string holes 48 in frame 47. Similarly horizontal strings 25 pass around and bear against nubs 45 as they are deflected down through their string holes 48. The nubbed strip 44 is held in place by the tension in the strings as they are tightly wound through perforations 48, although cement may be used.

Figure 15:
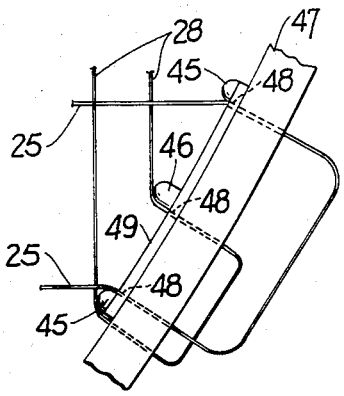
FIG. 15 is a partial elevation view above a racquet throat showing the nubbed strip of FIGS. 14*a* and 14*b* assembled to the racquet.

It can be seen that the configuration of nubbed strip 44 is determined by the string pattern of the particular model racquet in which the strip is used. Vibrations propagated along the strings in FIG. 15 are first received by the nubs 45 and 46 where they are damped by the dampening material before they pass to the frame.

Two samples of the same model racquetball racquet, one employing a pair of nubbed strip dampening devices and one without any dampening device were tested at the frequency producing the maximum response at the handles. Using the log decrement formula described in connection with FIGS. 12 and 13, the log decrement for the first half-second in the undamped device was 0.0033 and for the device damped with the nubbed strip was 0.0045, showing the advantages of use of the nubbed strip.

Having described preferred embodiments of the present invention, it is to be understood that although specific terms and examples are employed, they are used in a general and descriptive sense and not for purposes of limitation; the scope of the invention being set forth in the following claims.

We claim:

1. An improvement in a racquet having a substantially oval shaped frame perforated for the reception of strings with the frame tapering into a handle and a throatpiece having a curved top surface forming the remainder of the oval and also being perforated for the reception of strings, said throat piece having sides that taper together from the ends of the curved surface, the taper of the sides being substantially the same as the taper of the frame ends, and the throat piece sides being aligned with and situated completely within the inside of the frame ends, the improvement comprising means for dampening frame vibrations and string vibrations through the throat piece to the frame when the racquet is strung through the frame and the throat piece perforations, said means comprising a retainer of dampening material placed between the inside of each tapering end and throat piece side, said retainer having a first longitudinal recess for receiving a portion of said throat piece and a second, opposed longitudinal recess for receiving a portion of said frame.

2. A racquet comprising:

(a) a handle;

(b) a substantially oval shaped frame, said frame being perforated for reception of strings, said frame ends tapering into the handle;

(c) means for dampening string vibrations and frame vibrations before they reach the handle, said means comprising:

(i) a retainer aligned on the inside of each tapering frame end, said retainers having peripheral upraised edges on opposite surfaces;

(ii) one dampening strip of dampening material enclosed within the peripheral edges of one surface of each retainer, said dampening strip protruding above the peripheral edges of the retainer and being aligned with the tapering frame ends and the retainer;

(iii) a throat piece having a curved top surface forming the remainder of the oval, said throat piece having sides that taper together from the ends of the curved surface, the taper of the sides being substantially the same as the taper of the frame ends and the sides being aligned between the pairs of retainers, dampening strips and frame ends and being situated therebetween; and (iv) means for fastening the tapering frame ends, the two dampening strips, the two retainers and the throat piece together.

3. A racquet according to claim 2 in which the fastening means are threaded fasteners.

4. A racquet according to claim 2 in which the dampening strip is of elastomer.

5. A racquet according to claim 2 in which the throat piece, the retainers and dampening strips are perforated and the throat piece perforations extend from the curved edge through the tapered sides, said throat piece side perforations, retainer perforations and dampening strip perforations aligning with the tapering frame end perforations for passage of racquet strings therethrough.

* * * * *